United States Patent [19]

Tazuki et al.

[11] Patent Number: 4,520,089

[45] Date of Patent: May 28, 1985

[54] ELECTROPHOTOGRAPHIC OFFSET MASTERS

[75] Inventors: Shoji Tazuki; Koji Toyama, both of Tokyo, Japan

[73] Assignee: Mitsubishi Paper Mills, Ltd., Tokyo, Japan

[21] Appl. No.: 533,814

[22] Filed: Sep. 19, 1983

[30] Foreign Application Priority Data

Sep. 21, 1982 [JP] Japan ..... 57-164282

[51] Int. Cl.[3] ..... G03G 5/10

[52] U.S. Cl. ..... 430/49; 430/60; 101/467

[58] Field of Search ..... 430/60, 62, 63, 49; 162/138; 101/467

[56] References Cited

U.S. PATENT DOCUMENTS 4,060,451 11/1977 Uchiyama et al. ..... 162/138

4,427,754 1/1984 Uchida et al. ..... 430/60

*Primary Examiner*—John E. Kittle

*Assistant Examiner*—John L. Goodrow

*Attorney, Agent, or Firm*—Cushman, Darby & Cushman

[57] ABSTRACT

Disclosed is an electrophotographic offset master which contains sericite or sericite-containing inorganic pigment as pigment component in back coat layer. This offset master has no fogging on the photosensitive layer and thus causes no stains on printed copies.

7 Claims, No Drawings

ELECTROPHOTOGRAPHIC OFFSET MASTERS

This invention relates to an electrophotographic offset master and more particularly it relates to an improvement of a back coat layer of an electrophotographic offset master having a back coat layer.

As is well known, the reproduction system according to electrophotography comprises subjecting a photoconductive material coated on a base as an electrophotographic photoconductive layer to electrical charging, exposing, developing and fixing to obtain copies. This is the so-called electro-fax method. Such method is utilized for producing not only the general copies, but also master papers from which images are transferred to normal papers before fixing of the copied images or offset masters for offset printing.

Recently, the offset master for offset printing made by electrophotographic method has rapidly come into wide use because of ease in handling. This electrophotographic offset master can be used for obtaining printed copies by rendering non-image areas hydrophilic with an etch solution after developing and fixing and then mounting the master in an offset printing machine. It is necessary that the printed copies have no stains.

With reference to the "stain" made during printing, one of the causes of stains is insufficient desensitization of the offset master to oil, which includes not only the case where the photoconductive layer per se does not have sufficient desensitizability, but also the case where the surface of the photoconductive layer of the offset master has local flaws, which are insufficiently desensitized to cause "stains" during printing. These flaws in the photoconductive layer are the so-called "fogging". Especially, the conventional electrophotographic offset masters are more liable to cause "fogging" than other photosensitive materials and cannot be considered to be masters which can be used for printing.

Various types of fogging occur in electrophotographic offset masters, but that which is more striking than in other photosensitive offset masters is the fogging caused by the so-called mechanical stresses which is called friction fogging or pressure fogging. Such fogging may occur strongly when a person who handles masters inadvertently strikes the masters against other bodies or drops them on the floor, but they may also occur during the course of production of masters, namely, steps of coating of photoconductive solution, drying, taking-up, cutting, finishing, etc. where various mechanical stresses are applied to the masters to result in scratches or pressed portions which may cause fogging.

Measures for avoiding fogging have been taken in aspects of apparatus and operation in the course of making the masters. However, it is difficult to prevent fogging and especially very difficult to completely avoid fogging caused by friction. Reduction of production efficiency or yield has been brought about upon trying to avoid fogging. Sometimes, masters having such fogging have been included in the masters produced.

The object of this invention is to provide an offset master having no fogging on the surface of photoconductive layer thereof and a method for making the same without causing deterioration of image characteristics. That is, the object of this invention is to provide an offset master which causes few stains during printing and a method for making same.

Countermeasures against fogging in electrophotographic offset masters according to this invention will be explained below in detail.

Generally, in case of the electrophotographic offset masters, polymeric resins soluble in organic solvents are used as binders for a photoconductive layer. Therefore, non-image areas are hydrophobic unless they are subjected to desensitization treatment and are ink-receptive. Hence, if the desensitization treatment is not even and there are portions incompletely desensitized, ink sticks to these portions, which appear as fogging in printed copies. Furthermore, when mechanical stresses are applied to the photoconductive layer and strains are produced in a homogeneous dispersion system of zinc oxide and binder, photosensitivity of the strain portions decreases and the images of the master per se are also fogged, but in some cases there may occur such portions in the strain portions where binder is excessive and which are difficult to be desensitized and in this case fogging appears only after printing.

In order to reduce such problems, one may firstly think of increasing mechanical strength of photoconductive layer, but increase of mechanical strength brings about other problems. For example, when strength of the layer is increased by reducing the mixing ratio: zinc oxide (pigment)/binder in photoconductive layer, photosensitivity decreases and besides desensitization becomes very difficult. Thus, the effect becomes opposite to the original object of this invention. Furthermore, when strength of the layer is increased by increasing the molecular weight of the binder in the photoconductive layer, not only do there occur problems in stability and applicability of coating liquid, but electrophotographic characteristics such as sensitivity and the like are liable to decrease. Moroever, when hard binders for photoconductive layer are used in an attempt to reduce flaws, there occurs the problem of curling.

For these reasons, the inventors have considered that there is a limit in coping with these problems by only considering the compositions of the photoconductive layer and have decided to consider countermeasures in respect of the layers.

The inventors have first paid attention to back coat layer. This is because the surface of photoconductive layer of electrophotographic offset master contacts with back coat layer during winding, finishing, transportation and storage and until being used for printing and mostly the mechanical stresses are caused to be applied to the photoconductive layer through the back coat layer. Thus, it is considered that the back coat layer is the layer which gives the greatest effect.

The inventors prepared many kinds of electrophotographic offset masters the same in photoconductive layer and different in composition of the back coat layer for investigation of effects of the back coat layer. Two sheets of these were superposed so that the surface of the photoconductive layer and that of the back coat layer contacted with each other and then they were applied with mechanical stress by rubbing them together or beating them. Thereafter, printing plates were made from these masters and printing was carried out with these printing plates and the degrees of fogging were compared. As a result, it was found that effects of the composition of the back coat layer on fogging due to friction and pressure were greater than the inventors have expected and much greater than those of the composition of photoconductive layer. This invention has been made based on the facts found following these experiments.

That is, according to this invention, it has become possible to conduct printing with little fogging by using sericite as pigment component in the composition of back coat layer of electrophotographic offset masters.

The sericite used in this invention is very fine mica which has the chemical composition close to that of muscovite, but slightly different from the ideal chemical composition of muscovite. Sericite differs in composition depending on the place of its production and the method of production. Ideal chemical composition of muscovite is shown by $K_2O.3Al_2O_3.6SiO_2.2H_2O$ ($K_2O$ 11.8%, $Al_2O_3$ 38.5%, $SiO_2$ 44.2%, $H_2O$ 4.5%) while sericite has the characteristics in that the ratio $SiO_2/Al_2O_3$ is greater, content of $K_2O$ is lower and content of $H_2O$ (water to be released at 105° C. or higher) is higher than those of muscovite. Potassium in the chemical composition of sericite loosely lies between crystal layers. Therefore, crystal grains are easily peeled at the portion, i.e., easily cleaved and exhibit physically "lubricating properties". Outer shape of sericite is hexagonal plate crystal which has a unit crystal height of 10 Å.

In this invention, it is preferred to use pure sericite component, but inorganic pigments containing sericite may be used from the view point of cost and coating liquid property. In this case, content of sericite in the inorganic pigments, e.g. zieclite, quartz, etc., is preferably at least 30%.

Particle size of sericite and the sericite-containing inorganic pigment per se is generally 0.05–5μ. When coating property of the back coat layer is considered, it may be about 0.1μto about 4μ. When the particle size is too large, there occur problems in coating and dispersing properties while when too small, the effects cannot be sufficiently exhibited.

With reference to the amount of sericite and inorganic pigments containing sericite, the inorganic pigments containing at least 30% of sericite are preferred as mentioned above and generally, pigments for back coat layer are used in an amount of about 5 g/m$^2$–about 17 g/m$^2$. Thus, the object of this invention can be attained by using substantially at least about 1.5 g/m$^2$ of sericite component.

It cannot be denied that hitherto in the field of electrophotographic papers including electrophotographic offset masters the pigment component in the back coat layer composition has not been treated fully as compared with other components such as binders, electroconductive agents, water proofing agents, water repellants, etc.

The above fact will be well shown by the expression of "using, if necessary, pigments for preventing blocking and increasing smoothness" or "using pigments for attractiveness, non-tackiness and as calendering ability imparting agents". However, when electrophotographic paper is actually commercialized, attractiveness, non-tackiness and calendering property are important characteristics and these cannot be ignored. Therefore, in most of the electrophotographic papers, pigments are incorporated in a precoat layer or back coat layer. Pigments have further actions of making the coat layers porous to shorten the time for apparent drying and fixing during liquid development and of preventing blister at heat fixation.

In spite of these important actions of pigments, there have been very few patents and literatures which have analyzed the functions of pigments and made mention of selection of pigments in electrophotographic papers. Most of the examples shown used kaolin clay as pigments.

Japanese Patent Laid-Open Application (Kokai) No. 86025/74 which proposed use of porous pigments for shortening apparent drying time and fixing time at liquid development is a rare example which refers to functions and selection of pigments.

The inventors have paid attention to the pigment in a back coat layer and examined various pigments for paper coating. As a result, they have attained this invention.

As mentioned above, it is the greatest characteristic of this invention that the problem of fogging has been improved by selecting a specific pigment for a back coat layer which is non-image receiving layer of electrophotographic offset master which uses zinc oxide.

This pigment must not damage the characteristics required as electrophotographic offset masters such as plate making ability, printability, etc. even if the fogging can be prevented. According to this invention, the problem of fogging can be overcome without deteriorating any characteristics.

The electrophotographic offset masters are supplied in the form of continuous rolls or sheets of a certain size and generally, fogging is more liable to occur in the latter form. However, when a great number of the masters made in accordance with this invention are set in a plate making machine which makes printing plates in sheet form and printing plates are made therefrom, excellent printed copies with no fogging can be obtained using these printing plates.

The reason why this invention has the effect of reducing the fogging caused by friction or pressure is that even if the surface of photoconductive layer undergoes physical changes caused by mechanical stress, there is caused no decrease of desensitizability of that surface and this seems to be because local portions where binder is present in excess amount are not formed in the photoconductive layer due to the hexagonal plate shape or lubricity of sericite or compositions of the back coat layer other than pigment components which are oleophilic materials and do not transfer and stick to the fogged portions of the photoconductive layer.

The electrophotographic offset masters comprise a base paper one side of which is provided with a back coat layer and another side of which is provided with a precoat layer having a photoconductive layer directly thereon or through an intermediate layer which improves the printing endurance. Any base papers may be used. The precoat layer must have appropriate solvent resistance (oil resistance) because the photoconductive layer or/and the intermediate layer is coated as organic solvent solution. The precoat layer is required to have a strong adhesion to the base paper and solvent resistance as characteristics of electrophotography, especially, offset masters. As binders for the precoat layer there may be used water soluble polymeric materials such as polyvinyl alcohol, modified starch, casein, cellulose derivatives, gelatin, etc. and generally, inorganic pigments such as clay, titanium oxide, calcium carbonate, etc. are used therewith for improving image properties. On the other hand, the back coat layer is not especially required to have solvent resistance, but preferably the binders similar to those used for the precoat layer are used from the point of balancing with the precoat layer, namely, the problem of curling and printing endurance.

One embodiment of the electrophotographic offset master to which this invention may be applied comprises totally four layers (including base paper) of base paper as a substrate (support), a precoat layer and a back coat layer which impart functions as electrophotographic substrate to said base paper and a photoconductive layer provided on said precoat layer like the electrophotographic photosensitive papers for business reproduction. The precoat layer may be coated on the support at a coating amount of about 8–about 30 g/m$^2$, preferably about 10–about 20 g/m$^2$. The back coat layer is coated at a coating amount of about 8–about 30 g/m$^2$, preferably about 10–about 25 g/m$^2$. The photoconductive layer provided on the precoat layer may be formed by coating a mixed liquid which is prepared by dispersing photoconductive zinc oxide and an insulating synthetic resin binder in an organic solvent and further adding a sensitizer, etc. thereto and which contains 10–40 parts by weight, preferably 10–30 parts by weight of the binder resin per 100 parts by weight of zinc oxide. As the binder resins, there may be used, for example, conventionally known resins such as acrylic resins, silicone resins, alkyd resins, etc. and as the solvents, those such as toluene, xylene, etc. may be optionally used. The photoconductive layer may be coated at a coating amount of about 10–about 40 g/m$^2$, preferably about 15–about 30 g/m$^2$. (The coating amounts are all based on solid matter).

Compositions of the back coat layer include binders, electroco-conductive agents, water proofing agents, water repellants, etc. besides the pigment as mentioned above. As compared with the general electrophotographic paper, electrophotographic offset masters contact with water in their use and so the back coat layer is strongly required to have water resistance and hence naturally many of the other components are also those which are hydrophobic or oleophilic. Not to mention the water resisting agents and water repellants, in many cases, hydrophobic binders are used as a binder, too.

For example, as the water resisting agents, mention may be made of melamine-formalin resins, urea-formalin resins, polyamide resins, epoxy resins, etc. As the water repellants, mention may be made of various waxes, silicones, fluorinated hydrocarbons, organic zirconium salts, etc. As the binder latexes, mention may be made of styrene-butadiene latex, (metha)acrylic acid ester-butadiene latex, polyvinyl acetate latex, polyvinylidene chloride latex, poly(metha)acrylic ester latex, vinyl acetate-acrylic acid copolymer latex, acrylonitrile-butadiene copolymer latex, vinyl chloride-vinyl acetate copolymer latex, ethylene-vinyl acetate latex, etc.

The following are comparative examples and examples of this invention.

COMPARATIVE EXAMPLE

On the surface of a water resistant base paper of 120 g/m$^2$ in weight was coated a coating composition for a precoat layer which comprised 100 parts by weight of kaolin clay (Ultra White ® manufactured by Engelhard Corporation), 40 parts by weight of polystyrene pigment, 15 parts by weight of poval and 5 parts by weight of sodium sulfamate (these parts were all based on solid matter) at a coating amount (solid matter) of 8 g/m$^2$. Then, on the back surface of the base paper was coated a coating composition for back coat layer which comprised 150 parts by weight of kaolin clay, 100 parts by weight of styrene-butadiene resin, 2 parts by weight of poval and 20 parts by weight of polyvinylbenzyltrimethylammonium chloride at a coating amount (solid matter) of 12 g/m$^2$. Then, on said precoat layer was coated a coating composition (dispersion in toluol) comprising 200 parts by weight of photoconductive zinc oxide, 40 parts by weight of an organic solvent soluble acrylic binder resin and 0.20 parts by weight of Rose Bengale at a coating amount (solid matter) of 25 g/m$^2$ to obtain an electrophotographic offset master.

Two of these masters were superposed so that the surface of photoconductive layer of one master contacted with the surface of the back coat layer of another master. Then, these were rubbed together with each other whilst applied with a certain load thereto or pressure was applied thereto by a pressing machine. Thereafter, the master having the photoconductive surface which contacted with the back coat surface was set in an electrophotographic plate making machine DIA FAX EP-11 (manufactured by MITSUBISHI PAPER MILLS LTD) and a printing plate was made from said master. Then, this was subjected to desensitization treatment with DIA FAX LOM-OH (having hexacyanoferrate as main agent, manufactured by MITSUBISHI PAPER MILLS LTD.) which was an etch solution for electrophotographic offset master. Then, printing was carried out with this printing plate by printing machine TOKO Model-810 (manufactured by TOKYO KOKUKEIKI CO., LTD) to obtain a printed copy having strong fogging at the portions which were rubbed or applied with pressure.

EXAMPLE 1

Masters were produced in the same manner as Comparative Example 1 except that 150 parts by weight of the kaolin clay which was the pigment component in the coating composition for the back coat layer was replaced with 150 parts by weight of sericite (inorganic pigment containing 95% of sericite: Trade name "SERICRON" ® produced by MURAKAMI NENDO CO., LTD.). These masters were applied with mechanical stresses and then subjected to plate making and printing in the same manner as in Comparative Example 1. Substantially no fogging was found in the printed copies.

EXAMPLE 2

Comparative Example 1 were repeated except that 150 parts by weight of the kaolin clay which was the pigment component in the coating composition for the back coat layer in Comprative Example 1 was replaced with 150 parts by weight of zieclite pigment (containing 35% of sericite and produced by Zieclite Chemical Co., Ltd.). The resultant printed copies has substantially no fogging.

EXAMPLE 3

The masters made in Example 1 were cut to B4 size. More than 10 sheets of these masters were set in electrophotographic plate making machine ELEFAX AP-1 (manufactured by IWASAKI TSUSHINKI CO., LTD.) and printing plates were made. Then, printing was carried out with these plates in the same manner as in Comprative Example 1. No fogging occurred in any of the printed copies.

COMPARATIVE EXAMPLE 2

The masters obtained in Comparative Example 1 were made into printing plates in the same manner as in Example 3. Five sheets of the masters had fogging.

EXAMPLE 4

Masters made in the same manner as in Example 1 except that 150 parts by weight of sericite was replaced with 100 parts of sericite and 50 parts of kaolin clay had nearly the same results as those of Example 1.

COMPARATIVE EXAMPLE 5

Masters made in the same manner as Comparative Example 1 except that 150 parts by weight of the kaolin clay in the back coat layer was replaced with 150 parts by weight of calcium carbonate (ESCALON® produced by SANKYO SEIFUN CO., LTD.) had no fogging due to friction as in the Examples of this invention, but quality of images was reduced. (It seems that some problems were brought about in conductive characteristic.).

COMPARATIVE EXAMPLE 6

Masters made in the same manner as Example 1 except that 150 parts by weight of the sericite in the coating composition for back coat layer was replaced with 30 parts by weight of sericite and 120 parts by weight of kaolin clay had strong fogging and could not be practically used.

What is claimed is:

1. Electrophotographic offset master which comprises a support and at least a back coat layer, a precoat layer and a photoconductive layer on said support wherein said back coat layer contains as pigment component, sericite or a pigment containing at least 30% of sericite.

2. Electrophotographic offset master according to claim 1 wherein the pigment is used in an amount of about 5 $g/m^2$–about 17 $g/m^2$.

3. Electrophotographic offset printing plate made by imagewise exposure of the master of claim 1 and subsequent development and fixation.

4. A method of plate making which includes the steps of imagewise exposure of the master of claim 1 and subsequent development and fixation.

5. A method of printing with the offset printing plate of claim 3.

6. A method according to claim 1 wherein there is used pure sericite as the pigment.

7. A method according to claim 1 wherein at least about 1.5 $g/m^2$ of sericite is used.

* * * * *